US011640813B2

(12) United States Patent
Black et al.

(10) Patent No.: US 11,640,813 B2
(45) Date of Patent: May 2, 2023

(54) STRING BENDER FOR STRINGED INSTRUMENT

(71) Applicants: James Wade Black, Clarksville, AR (US); Barry Alan Bateman, Knoxville, AR (US)

(72) Inventors: James Wade Black, Clarksville, AR (US); Barry Alan Bateman, Knoxville, AR (US)

( * ) Notice: Subject to any disclaimer, the term of this patent is extended or adjusted under 35 U.S.C. 154(b) by 144 days.

(21) Appl. No.: 17/184,491

(22) Filed: Feb. 24, 2021

(65) Prior Publication Data

US 2021/0264885 A1 Aug. 26, 2021

Related U.S. Application Data

(60) Provisional application No. 62/981,710, filed on Feb. 26, 2020.

(51) Int. Cl.

| | |
|---|---|
| ***G10D 3/153*** | (2020.01) |
| ***G10D 3/04*** | (2020.01) |
| ***G10D 1/08*** | (2006.01) |

(52) U.S. Cl.

CPC ..... *G10D 3/153* (2020.02); *G10D 1/08* (2013.01); *G10D 3/04* (2013.01)

(58) Field of Classification Search

CPC ..... G10D 3/153; G10D 1/08; G10D 3/04; G10D 3/00

See application file for complete search history.

(56) References Cited

U.S. PATENT DOCUMENTS 7,935,876 B1 * 5/2011 West ..... G10D 3/153 84/200

* cited by examiner

*Primary Examiner* — Kimberly R Lockett
(74) *Attorney, Agent, or Firm* — Scarinci Hollenbeck, LLC; Libby Babu Varghese

(57) ABSTRACT

A string bender mechanism for a string musical instrument having a bender assembly comprising a control member and at least two bender levers. The control member moving between a first position and at least a second position, being a rest and active position, respectively. The at least two bender levers have a first end and a second end. The first end of said bender lever is dimensioned or adjacent to the control member and the second end of the bender lever receives a string. When the control member is in the first position, the bender levers are at rest and a tone emanates from a plucked string. When the control member is in the second position, the bender levers move simultaneously, and a varied tone emanates from a plucked string. In an alternative embodiment, one or more bender levers may be replaced with a switcher assembly.

13 Claims, 6 Drawing Sheets

STRING BENDER FOR STRINGED INSTRUMENT

PRIORITY CLAIM

This application is based upon and claims the benefit of priority from U.S. Prov. Appln. Ser. No. 62/981,710, filed on Feb. 26, 2020, the entire contents of which are incorporated herein by reference.

FIELD OF THE INVENTION

The present disclosure is directed to stringed musical instruments. Specifically, the invention relates to string bending devices suited for use with stringed musical instruments.

BACKGROUND OF THE INVENTION

Devices exist in the music industry which allows musicians of stringed instruments, such as guitars, to mechanically alter the pitch of a string. Such a device allows the artist great flexibility in providing a vibrato effect on a single string of the instrument. It is often used in country music to provide a country twang.

There are some known string benders which currently exist in the marketplace and each design varies greatly in terms of how it is mounted on the guitar and how it is activated during the playing of a guitar. The string bending devices of the prior art tend to be relatively complex.

There exists a need for a guitar string bender which can allow for the bending of multiple strings simultaneously. There is a need to pull, or bend, strings a halftone, a whole tone or two full tones. What is also desired is a single linkage to multiple string bender levers. What is desired is a mechanism that bends/pulls all string bender levers simultaneously.

What is further desired is a device that decreases the complexity of tuning a varied note, or a bent note, and improves the tuning stability, accuracy and precision of sound created. It is also desired that each string bender lever pull a string at different amounts of force based on a radius, start position and stop position of a string bender lever.

SUMMARY OF THE INVENTION

A string bender mechanism for a string musical instrument having a bender assembly comprising a control member and at least two bender levers. The control member moving between a first position and at least a second position, being a rest and active position, respectively. The at least two bender levers have a first end and a second end. The first end of said bender lever is dimensioned or adjacent to the control member and the second end of the bender lever receives a string. When the control member is in the first position, the bender levers are at rest and a tone emanates from a plucked string. When the control member is in the second position, the bender levers move simultaneously, and a varied tone emanates from a plucked string.

An actuator connects to the control member. The actuator may include a strap lever assembly such as but not limited to a guitar strap or a belt lanyard. The bender assembly may be disposed behind a string instrument bridge or may be a guitar bridge. In some embodiment there may be three bender levers or more. Each said bender lever has a radius that correlates to bending each string a varied note. A stop may be located behind a string instrument bridge within the string musical instrument. A stop may be dimensioned and configured to each bender lever.

In another embodiment, the string bender mechanism has a bender assembly comprising a control member and at least one switcher assembly. The control member moving between a first position and at least a second position such as between an off and on position, respectively. The switcher assembly includes a second bender lever, a second bender stop lever, and a switch.

The switcher assembly includes a first end and a second end. The first end of the switcher assembly is dimensioned to the control member and the second end selectively receives a string. The first end of said switcher assembly includes the second bender lever, and a first end of the second bender stop lever while the second end of said switcher assembly includes a second end of the second bender stop lever and said switch.

When the switch of the switcher assembly is in an on-position, the second end of the switcher assembly receives the string permitting a varied note to emanate from the plucked string. When the switch is in an off-position, said second end of the switcher assembly releases the string where a note, a standard note or tone, to emanate from the plucked string.

When the control member is in the first position, or at rest, the switcher assembly is also at rest and a tone emanates from a plucked string. However, when the control member is in the second position, the control member moves. The position of the switch control whether a tone or a varied tone emanates from a plucked string. When the switch is in the off-position a tone emanates and when the switch is in the on-position a varied tone emanates from the plucked string.

In one embodiment, a tuning stop support block will be added to the mechanism. The tuning stop support block will assist in defining a position of the second bender stop lever wherein a varied tone can emanate. The varied tone emanating from the plucked string may be a halftone, a full tone or two full tones. Specifically, the switcher tuning stop that mounts to a top plate of a musical instrument is disposed in the tuning stop support block and moves up and down to achieve variations in the tone emanating from the plucked string.

DETAILED DESCRIPTION OF THE INVENTION

Figure 1:
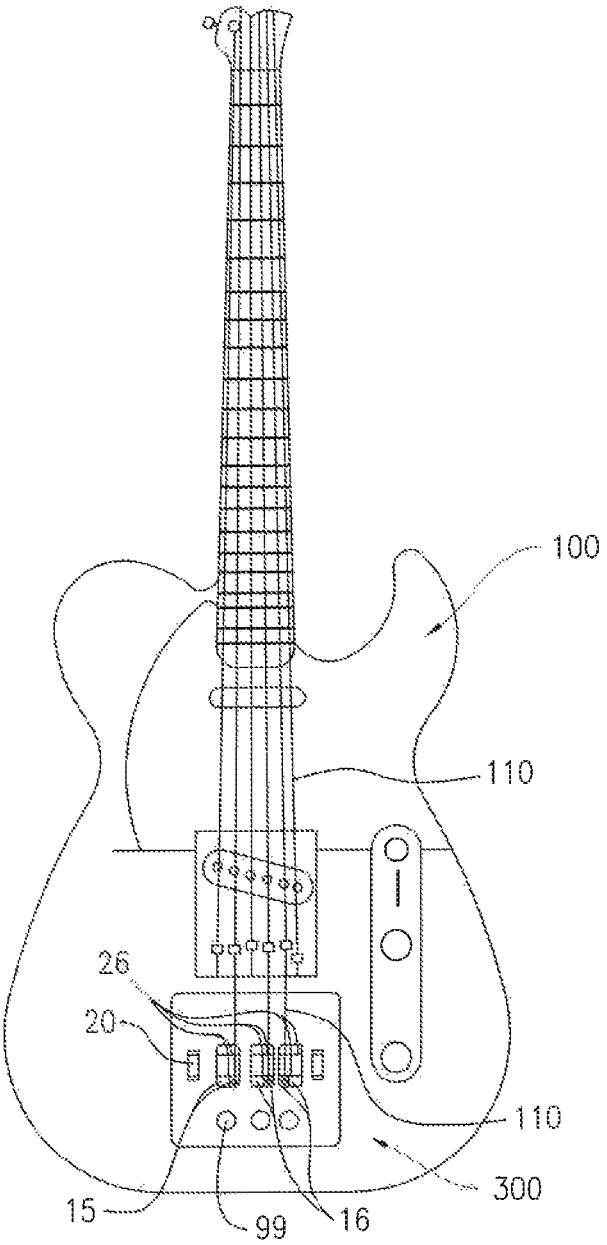
FIG. 1 shows a front view of a musical instrument with a string bender mechanism disposed within.
Figure 2:
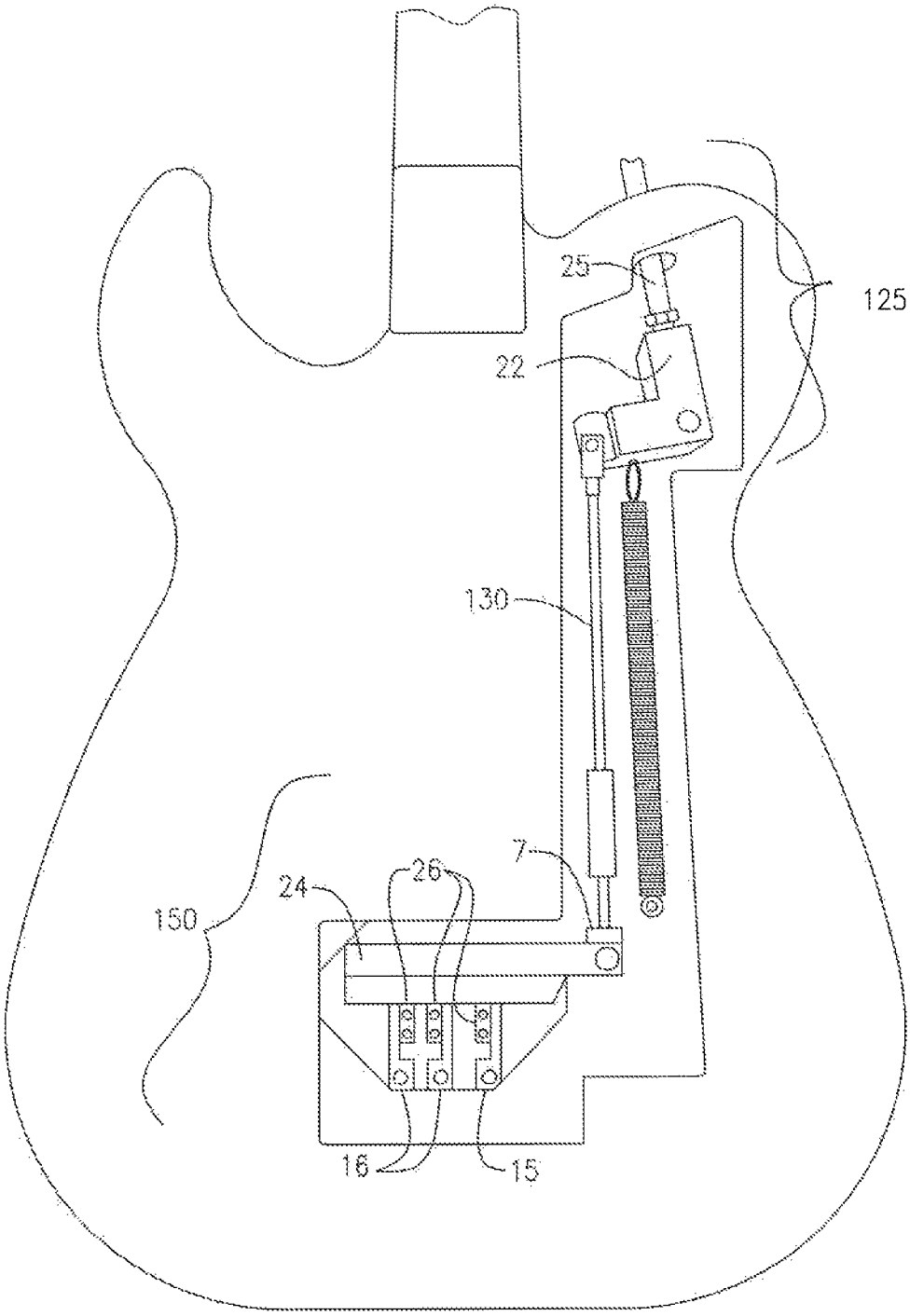
FIG. 2 shows a rear view of the musical instrument showing the bender mechanism.

FIG. 1 shows the front of a stringed musical instrument 100. FIG. 2, shows a string bender mechanism 125, 150 for the string musical instrument 100 of the present invention. In one embodiment, the string bender mechanism 125, 150 is disposed in the lower bout of the stringed musical instrument 100 behind the stringed musical instrument bridge. A top plate 300 on the front of the stringed musical instrument 100 and a back plate (not shown) conceals the inner workings of the bender mechanism 125, 150. The string bender mechanism 125, 150 comprises a strap lever assembly 125 disposed by the neck of the stringed musical instrument and a bender assembly 150 disposed at the lower bout of the stringed musical instrument. In one embodiment, the bender assembly 150 is mounted behind the guitar bridge. In another embodiment, the bender assembly 150 may be the guitar bridge.

Looking at FIG. 2, the strap lever assembly 125 may include a strap actuator lever 22 and a strap lever extension 25. Fasteners such as screws may be used to fasten the strap lever assembly 125 to the stringed musical instrument 100. A rod 130 is disposed between and connects to each the strap lever assembly 125 and the bender assembly 150. A spring may be used at the strap actuator lever 22 to maintain force on the strap actuator lever 22 so that the strings of the musical instrument 100 do not bend unintentionally when the string bender mechanism 125, 150 is inactive.

Figure 3A:
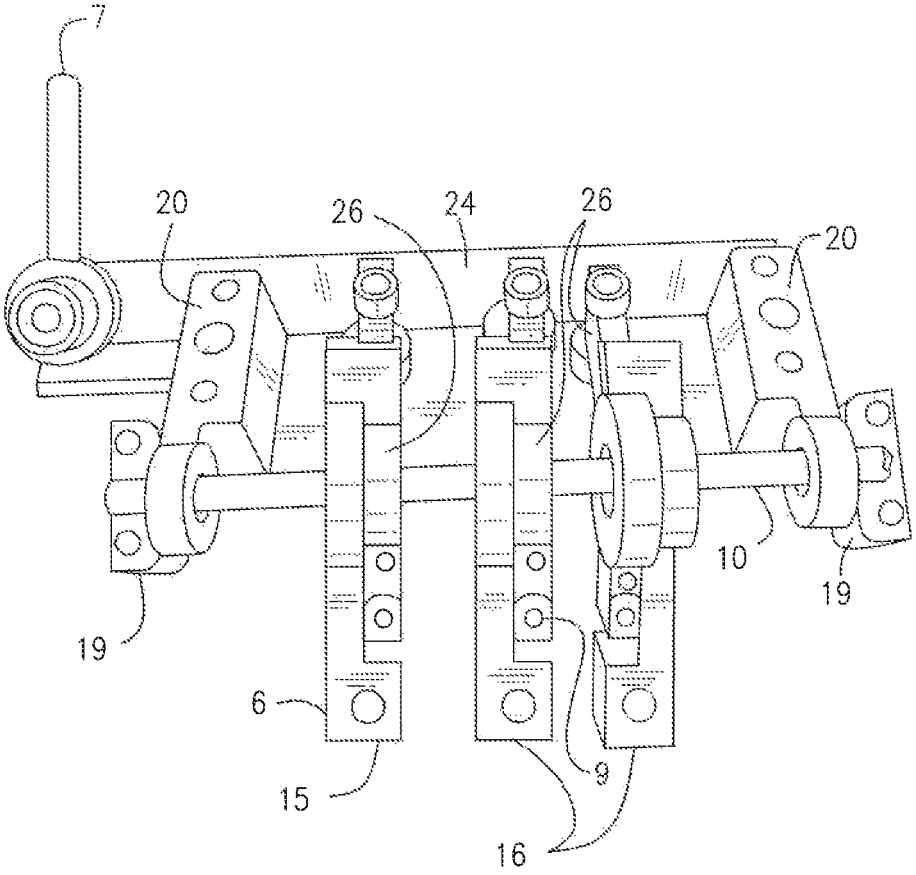
FIG. 3A shows a bender assembly of the bender mechanism shown from a front view.

The rod 130 connects via ball joint rod end 7 to the bender assembly 150 specifically to a control member 24. See FIG. 2. In one embodiment, the control member 24 connects to hinge levers 20 and first bender levers or string bender levers 26. FIG. 3A shows the bender assembly 150 with the front with the top plate 300 removed. In this front view, the ball joint rod end 7 is shown on the left of the control member 24 and the control member 24 is shown behind the bender assembly 150. The control member 24 is connected to hinge levers 20 and bender levers 26. Specifically, the control member 24 serves as a single linkage to the bender levers 26.

It should be said that control member 24 may take any form. In one embodiment, as shown in the figures, the control member 24 is a hinge plate. In another embodiment, control member 24 may include but is not omitted to levers in various forms. In another embodiment, control member 24 could be a series of cams that rotate in the same plane as the string. Here, the series of rotating cams would be connected to each other via gears and could be calibrated to turn at different ratios to simultaneously and accurately bend multiple strings 100 when actuated. In this embodiment, a hinge plate may not be used.

In yet another embodiment, control member 24 may comprise the multiple bender levers 26 linked to an axle rod 10. Here, instead of the axle 10 being static and bender levers 26 rotating on the axle 10, the axle 10 would rotate with the bender levers 26. The rod 130 in the strap lever assembly 125 or other actuator would be connected directly to the axle 10 so that it would cause the axle 10 to rotate.

In one embodiment, bender lever 26 may be used with $5^{th}$, $2^{nd}$, and $3^{rd}$ strings (counting from highest pitch/thinnest string gauge to the lowest pitch/thickest string gauge) of a six-string musical instrument. In another embodiment, the bender lever 26 may be a, b and g levers for corresponding strings of a six-string musical instrument. This is just one example of a musical instrument 100 that is tuned to perfect fourths and one major third prior to the bent notes. If the stringed instrument 100 were tuned to an open tuning (ex: G, B, D, G, B, G) instead, the bender assembly 150 can be used to bend one or all of these notes to obtain notes that are above those to which the strings are normally basically tuned. The bender assembly 150 can be applied to other tunings and other stringed instruments. For instance, in another embodiment, the bender lever 26 may be used for other number-string musical instrument on all strings or with at least any two strings.

Figure 3B:
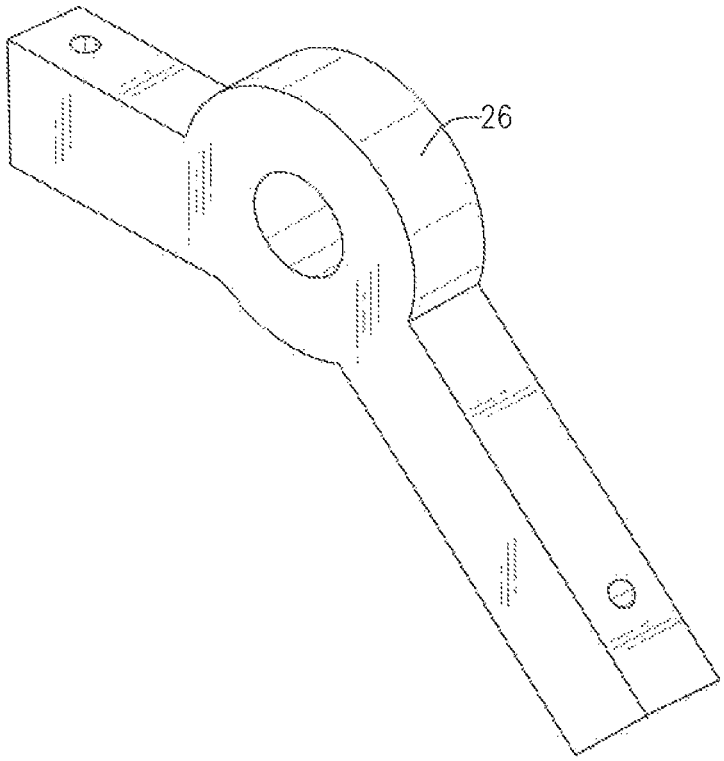
FIG. 3B shows a bender lever of the bender assembly.

FIG. 3B shows the bender lever 26. The bender lever 26 has a radius, a start position and a stop position that correspond to the amount of bend desired in a particular string. The amount of bend may correspond to two full tones, a whole tone or a half tone. The bender lever 26 has a specific radius corresponding to the amount of force or bend desired in a particular string intended to be pulled. The radius thus allows the bender lever 26 to pull or bend each string at a different amount of force due to the differences in gauge/diameter of each string. The radius also allows the bender lever 26 to pull or bend each string at a different amount of force due to whether or not the musical instrument string is pulled up a half tone, full tone or two full tones.

Each first bender lever 26 is connected to a first stop 15, 16. An axle rod 10 is disposed through each the stop 15, 16, the bender lever 26 and the hinge lever 20. The stops 15, 16 are adjustable stops for the lever 26 that allows a player to precisely and accurately adjust the tuning of the note, or the bent note, desired to be achieved.

Axle rod bearing mounts 19 are disposed by the outer or inner sides of the hinge lever 20. The axle rod bearing mounts 19 secure the axle rod in a proper position to the top plate. Barrel nuts 6 are used with the stops 15, 16 and permits making adjustments to a string in achieving a varied note such as a bent note. The stops 15, 16 limits the movement of the first bender lever 26. The stops 15, 16 limit is adjusted sharp or flat via a fine tune mechanism. Flat tip set screw 9 may be used within apertures 29 in the bender levers 26 for positioning and fine tuning of the "bent note" desired from a string. The screws 9 also help set the start position of the bent note. The screws 9 may be used as tuners to achieve a "bent note." The thumb screws 99 connect to the stops 15, 16 via barrel nuts 6 to allow the player to precisely adjust the tuning of the bent note. Springs may be used with thumb screws 99 to maintain force against the top plate 300 from stop 15, 16 so that "bent note" setting stays in place.

FIG. 1 shows a closer look at the top plate 300 with portions of the hinge lever 20, stops 15, 16 and bender levers 26 shown exiting openings in the top plate 300. The musical instrument strings 110 are shown connected to the bender levers 26. In one embodiment, the $5^{th}$, $2^{nd}$, and $3^{rd}$ strings of a six-string musical instrument are disposed through bender levers 26 to realize desired varied or bend notes. However, the bender mechanism 125, 150 is not limited to specific strings 110 or to any particular stringed musical instrument 100. For example, bender mechanism 125, 150 may be used with musical instruments having 5 strings, 7 strings, 8 strings or more or less.

In one embodiment, a player attaches a guitar strap to strap lever extension 25. When the player pushes down on the guitar neck the strap lever extension 25 will pull up. When the lever 25 pulls up, it pulls the rod 130 forward within the musical instrument 100 through a system of leverage. The rod 130, being pulled forward, activates control member 24, which simultaneously pulls up or bends multiple strings to achieve varied notes of a halftone, a whole tone or double tone.

For instance, with a standard tuning setup, the B string bends to C#, the G string bends to G# and the A string bends to B simultaneously. As an example, with this setup, an E chord bends up to an A chord, an F chord bends to Bb. The control member 24 lifts all levers simultaneously which decreases the complexity of tuning the bent note and improves the tuning stability, accuracy and precision. While raising multiple strings simultaneously a halftone, full tone or two full tones are good examples of the current usefulness, the range of pitch that the notes can be raised is only limited by the elastic capability of the string. It is not limited by the device.

Once the control member 24 is pulled forward, it pushes up the bender levers 26 to which the strings 110 are attached. When the bender levers 26 are pushed up, the strings are stretched which raises them either a half tone, a whole tone or two whole tones. With the simultaneous activation of the bender levers 26 the player is allowed to play a set of notes (a chord) that they would, otherwise, not be able to play. For instance, bending three strings simultaneously and accurately enables the player to easily simulate pedal steel chords and create other guitar licks that would, otherwise, be difficult or impossible on a standard six-string guitar. The present invention enables players to achieve guitar chords and licks that, otherwise, are out of reach.

Actuation may be realized by attaching the strap lever extension 25 to a guitar strap, as described above. Alternatively, other devices may be connected to the control member 24. In one non-limiting embodiment, a lanyard connected to the player's belt may be used to control member 24. When the strap lever extension 25 is actuated, the bender levers 26 are moved the control member 24.

Figure 4:
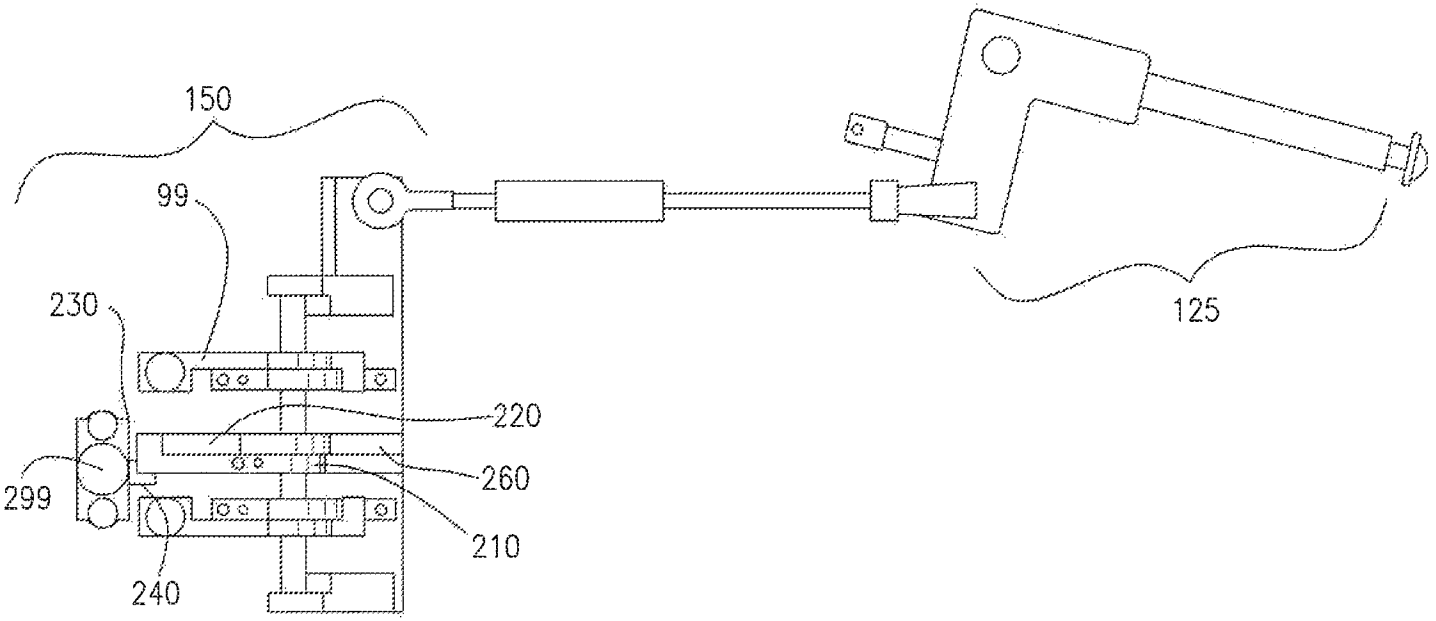
FIG. 4 shows a front view of a switcher assembly used with the bender assembly.
Figure 5A:
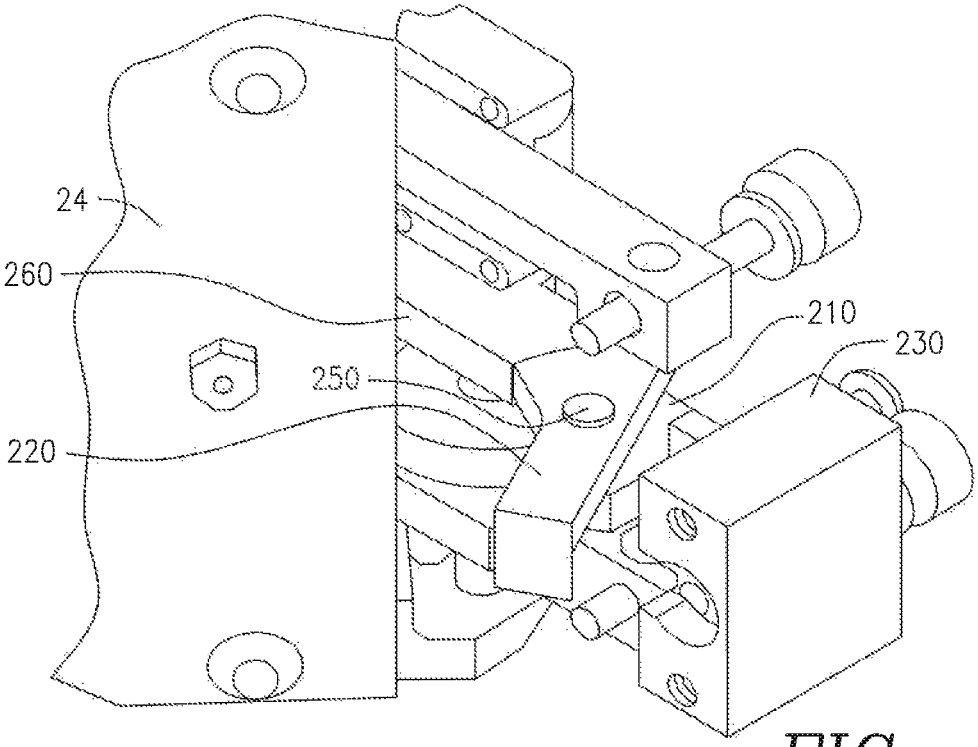
FIG. 5A shows a rear view of the switcher assembly of FIG. 4 in the engaged or an "on" position.

In another embodiment, the bender assembly 150 may include a switcher assembly 200 that may be used as a replacement for the first bender lever 26 and first stops 15, 16 as described above. See FIGS. 4, 5A and 5B. The switcher assembly 200 comprises a second bender stop lever 210, an on/off switch 220, second bender lever 260. Additional components to the assembly 200 may include tuning stop support block 230 switcher tuning stop or L-shaped stop 240. The second bender stop lever 210 and second bender lever 260 are each connected to the axle 10. The on/off switch 220 is mounted on the second bender lever 260 that may be held via a captive pin 250 that is held in place via a set screw.

The switcher assembly 200 allows the musical instrument player to switch on or off an individual string 110 or set of strings 110. When the on/off switch 220 is in the "on" position, See FIGS. 4 and 5A, switch 220 contacts or engages second bender lever 260 and the string(s) 110 are able to raise in pitch when the bender assembly 150 is activated. As stated above, an actuator such as a strap lever, a belt lanyard, etc. may be used to activate the bender assembly 150. When the on/off switch 220 is in the "off" position, See FIG. 5B, the switch 220 is disengaged from the second bender lever 260 the string(s) 110 do not raise in pitch as the bender assembly 150 is not activated.

The second bender stop lever 210 connects to the axle rod 10, which is a fulcrum, and is then bolted to a lever such as the control member 24. As a result, when the on/off switch 220 is turned "on" the second bender stop lever 210 moves with the control member 24 and a varied note can emanate from the string 110 when plucked.

Figure 5B:
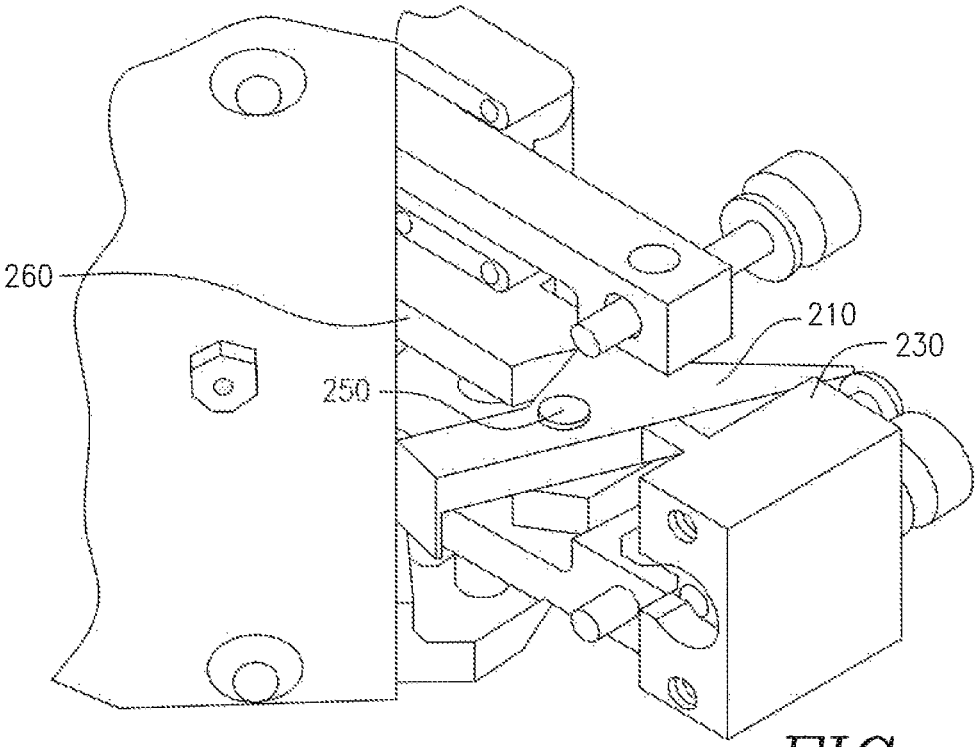
FIG. 5B shows a rear view of the switcher assembly of FIG. 4 in the engaged or an "off" position.

When the on/off switch 220 is turned "off", See FIG. 5B, the second bender stop lever 210 is static as the on/off switch 220 is not engaged with the second bender lever 260. Here the string 110 is not connected to the second bender stop lever 210 and a standard, or unvaried, note emanates from the string 110 when plucked.

A "start" position of the second bender stop lever 210 is determined by a set screw 299 that is driven through the second bender stop lever 210 (not shown in FIG. 4) and holds tight against the top/sub plates 300 (see FIG. 1) because the instrument string 110 holds the second bender stop lever 210 tight. A start or stop position of the second bender stop lever 210 is determined by the position of the tuning stop support block 230.

It should be noted that top plate 300 may include sub plates added to the top plate 300. The subplates increase string tension behind the bridge 120. They move the levers lower into the guitar cavity and, therefore, cause a steeper angle at which the string 110 exits the bender lever 26, 260 and contacts the bridge saddle. Some guitarist prefer lower or higher string tension behind the bridge 120 because it changes the tension of the string 110 and the tone of the musical instrument 100. Instead of stacking subplates, other variations may include a thicker top plate 300 or the top plate may be of a variable height to the top of the musical instrument 100 body.

The tuning stop support block 230 is mounted through the top plate 300 via a thumb screw 99. The tuning stop support block 230 is held in place by the switcher tuning stop or L-shaped stop 240 that is mounted to the top plate 300 and connects to the second bender stop lever 260. The switcher tuning stop or L-shaped stop 240 is mounted through the top plate 300 via a thumb screw 99. The switcher tuning stop or L-shaped tuning stop 240 is held in place by the tuning stop support block that is mounted to the top plate 300. The switcher tuning stop or L-shaped stop 240, which is disposed within the tuning stop support block 230, limits the movement of the second bender stop lever 260 as said switcher tuning stop or L-shaped stop 240 moves relative to the top plate 300. In one embodiment, fasteners such as machine screws hold the tuning stop support block 230 to the top plate 300. The L-shaped stop 240 travels up and down in the round channel inside the tuning stop support block 230. It is the L-shaped stop 240 that has the range of motion which is imparted to the switcher assembly 200. The tuning stop support block 230 allows the L-shaped stop 240 to move up and down inside of it and thus supports and keeps on track the movement of the switcher assembly as a user manipulates the switcher assembly 200 as desired. As a result, the tuning stop support block 230 has a range of motion that allows the stop position to be adjusted in a full range. In one embodiment, the range of motion, may be a range extending between a normally tuned instrument string and raising the pitch to the limit of the string's elastic strength. In one embodiment, the range of motion, may be a half tone, full tone or two full tones.

While specific embodiments of the invention have been described and illustrated, such embodiments should be considered illustrative of the invention only and not as limiting the invention as construed in accordance with the accompanying claims. One of ordinary skill in the art could alter the above embodiments or provide insubstantial changes that may be made without departing from the scope of the invention.

We claim:

1. A string bender mechanism for a string musical instrument comprising:

a bender assembly comprising, a control member, said control member moving between a first position and at least a second position;

at least two bender levers, said bender levers having a first end and a second end, said first end of said bender lever being dimensioned to the control member, said second end of the bender lever receiving at least one string;

wherein in the first position the control member and the bender levers are at rest and a tone emanates from a plucked string, and wherein in the second position the control member moves the bender levers simultaneously and a varied tone emanates from a plucked string; and an actuator, said actuator connected to the control member, wherein the actuator is a strap lever assembly.

2. The string bender mechanism of claim 1, wherein the bender assembly is disposed behind a string instrument bridge.

3. The string bender mechanism of claim 1, wherein the bender assembly is a guitar bridge.

4. The string bender mechanism of claim 1, wherein there are three bender levers.

5. The string bender mechanism of claim 1, wherein a stop is located behind a string instrument bridge within the string musical instrument.

6. The string bender mechanism of claim 1, wherein each said bender lever having a radius, wherein said radius correlates to bending each said plucked string to achieve said varied note.

7. The string bender mechanism of claim 1, wherein a stop is dimensioned and configured to each said bender lever.

8. A string bender mechanism for a string musical instrument comprising:

a bender assembly comprising, a control member, said control member moving between a first position and at least a second position; and at least one switcher assembly, said switcher assembly comprising a second bender lever, a second bender stop lever, and a switch, said switcher assembly having a first end and a second end, said first end of said switcher assembly comprising said second bender lever, and a first end of the second bender stop lever, said first end of said switcher assembly being dimensioned to the control member, said second end of said switcher assembly comprising a second end of the second bender stop lever and said switch, said second end of the switcher assembly selectively receiving at least one string, wherein when the switch is in an on-position, said second end of the switcher assembly receives the string, and when the switch is in an off-position, said second end of the switcher assembly releases the string, wherein in the first position the control member and the switcher assembly are at rest and a tone emanates from a plucked string, and wherein in the second position the control member moves and a tone emanates from a plucked string when the switch is in the off-position, a varied tone emanates from the plucked string when the switch is in the on-position.

9. The string bender mechanism of claim 8, further comprising a tuning stop support block, said tuning stop support block defining a position of the second bender stop lever.

10. The string bender mechanism of claim 9, wherein the varied tone emanating from the plucked string is a half tone.

11. The string bender mechanism of claim 9, wherein the varied tone emanating from the plucked string is a full tone.

12. The string bender mechanism of claim 9, wherein the varied tone emanating from the plucked string is two full tones.

13. The string bender mechanism of claim 9, wherein a switcher tuning stop disposed within the tuning stop support block moves the position of the second bender stop lever as said switcher tuning stop moves relative to the top plate.

* * * * *